US010711731B2

(12) United States Patent
Van Gerven et al.

(10) Patent No.: US 10,711,731 B2
(45) Date of Patent: Jul. 14, 2020

(54) METHOD FOR MANUFACTURING A WATER COOLING SYSTEM IN A CASTED CYLINDER HEAD AND WATER COOLING SYSTEM IN A CASTED CYLINDER HEAD

(71) Applicants: FEV Europe GmbH, Aachen (DE); Honda Motor Co., Ltd., Tokyo (JP)

(72) Inventors: John Van Gerven, Nieuwstadt (NL); Lukas Rüttgers, Alsdorf (DE)

(73) Assignees: FEV Europe GmbH, Aachen (DE); Honda Motor Co., Ltd., Tokyo (JP)

( * ) Notice: Subject to any disclaimer, the term of this patent is extended or adjusted under 35 U.S.C. 154(b) by 228 days.

(21) Appl. No.: 15/506,658

(22) PCT Filed: Jul. 22, 2015

(86) PCT No.: PCT/EP2015/066719
§ 371 (c)(1),
(2) Date: Feb. 24, 2017

(87) PCT Pub. No.: WO2016/030087
PCT Pub. Date: Mar. 3, 2016

(65) Prior Publication Data

US 2017/0234263 A1 Aug. 17, 2017

(30) Foreign Application Priority Data

Aug. 29, 2014 (DE) ..... 10 2014 112 461

(51) Int. Cl.
*F02F 1/40* (2006.01)
*B22C 9/10* (2006.01)
(Continued)

(52) U.S. Cl.
CPC ..... *F02F 1/40* (2013.01); *B22C 9/103* (2013.01); *B22C 9/108* (2013.01); *B22D 25/02* (2013.01);
(Continued)

(58) Field of Classification Search
CPC ..... B22C 9/103; B22C 9/108; B22D 25/02; B22D 31/002; F01P 2003/024; F01P 3/02; F02F 1/36; F02F 1/40
See application file for complete search history.

(56) References Cited

U.S. PATENT DOCUMENTS

2008/0092386 A1 4/2008 Hildebrand et al.
2009/0165298 A1 7/2009 Nagafuchi
(Continued)

FOREIGN PATENT DOCUMENTS

CN 101099037 A 1/2008
CN 101400462 A 4/2009
(Continued)

OTHER PUBLICATIONS

Notification of First Office Action for related Chinese application No. 201580046736.5 dated May 3, 2018, with its English translation, 9 pages.

*Primary Examiner* — Lindsay M Low
*Assistant Examiner* — Ruben Picon-Feliciano
(74) *Attorney, Agent, or Firm* — Michael J. Blessent; Rudy J. Ng; Bret E. Field

(57) ABSTRACT

The present invention is related to a method for manufacturing a water cooling system (20) inside a casted cylinder head (10), the water cooling system (20) comprising an upper water jacket (21) and a lower water jacket (22) and wherein a transition channel (23) is located between the upper water jacket (21) and the lower water jacket (22). Further, the invention is related to a water cooling system (20) inside a casted cylinder head (10), comprising an upper water jacket (21) and a lower water jacket (22) wherein the upper water jacket (21) and the lower water jacket (22) are fluidly connected by at least one transition channel (23).

9 Claims, 4 Drawing Sheets

Figure 1A:
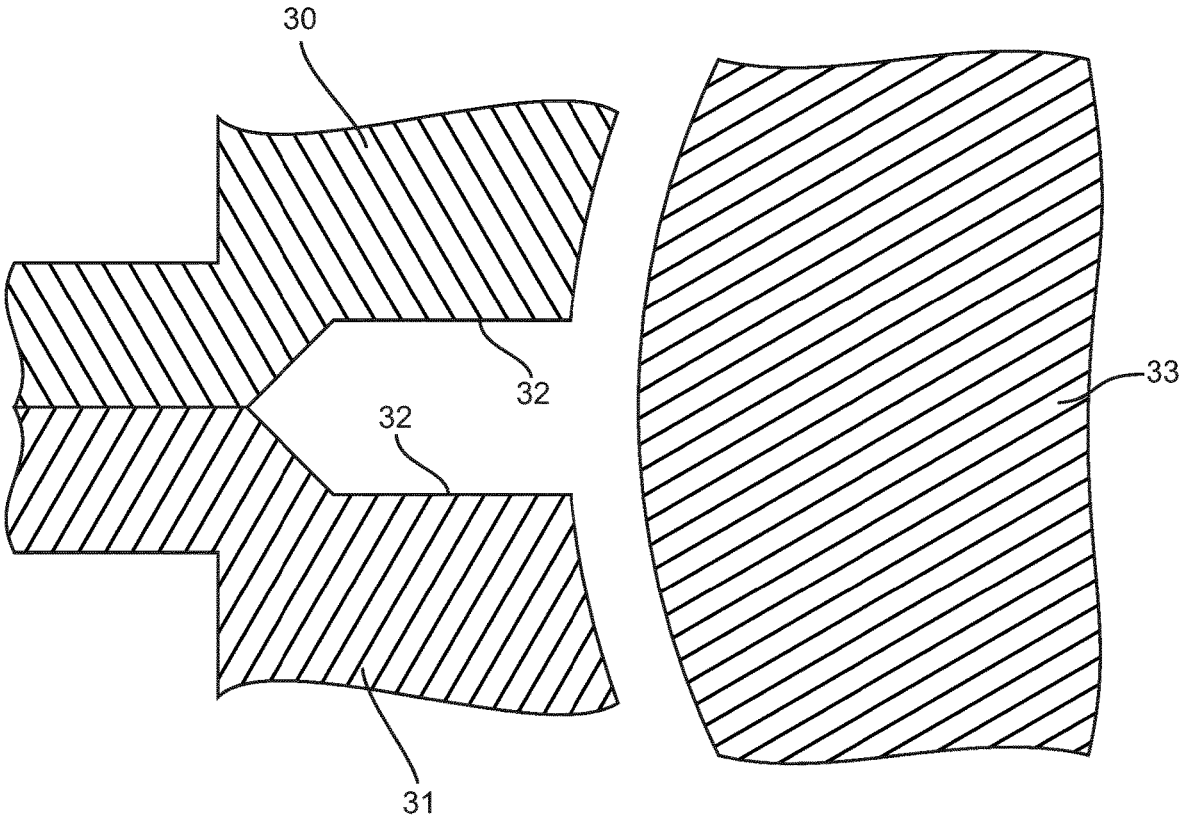

(51) Int. Cl.

| | |
|---|---|
| ***B22D 31/00*** | (2006.01) |
| ***B22D 25/02*** | (2006.01) |
| ***F01P 3/02*** | (2006.01) |
| ***F02F 1/36*** | (2006.01) |

(52) U.S. Cl.
CPC ..... *B22D 31/002* (2013.01); *F01P 3/02* (2013.01); *F01P 2003/024* (2013.01); *F02F 1/36* (2013.01)

(56) References Cited

U.S. PATENT DOCUMENTS

| | | | | |
|---|---|---|---|---|
| 2010/0089343 | A1 | 4/2010 | Hamada | |
| 2010/0319637 | A1* | 12/2010 | Ito | F02F 1/36 123/41.01 |
| 2011/0315098 | A1* | 12/2011 | Kosugi | B22C 9/103 123/41.74 |
| 2012/0073528 | A1* | 3/2012 | Kim | B22D 15/02 123/41.82 R |

FOREIGN PATENT DOCUMENTS

| | | | |
|---|---|---|---|
| JP | 2011020158 | A | 2/2011 |
| KR | 20030030118 | A | 4/2003 |
| WO | WO2014033012 | A1 | 3/2014 |

* cited by examiner

METHOD FOR MANUFACTURING A WATER COOLING SYSTEM IN A CASTED CYLINDER HEAD AND WATER COOLING SYSTEM IN A CASTED CYLINDER HEAD

The present invention is related to a method for manufacturing a water cooling system inside a casted cylinder head, the water cooling system comprising an upper water jacket and a lower water jacket and wherein a transition channel is located between the upper water jacket and the lower water jacket. Further, the invention is related to a water cooling system inside a casted cylinder head, comprising an upper water jacket and a lower water jacket, wherein the upper water jacket and the lower water jacket are fluidly connected by at least one transition channel.

It is known in modern combustion engines to comprise a water cooling system for cooling the combustion engine. Heat produced during an operation of the combustion engine is transferred into the water in a water jacket of the water cooling system and carried away to a heat dump, preferably a cooling unit, for instance a radiator. It is known to provide an internal water cooling system inside the combustion engine, as well in a cylinder block as in a cylinder head of the combustion engine. Especially in the cylinder head two or more water jacket cores can be used in the casting process to achieve the cavities for the water cooling system which are suited best for the cooling purposes during the operation of the combustion engine. Such cores for the casting process of cylinder heads are for instance disclosed in GP 11 173 211 A or DE 10 2008 057 338 A1.

Using several cores for the different water jackets of the water cooling systems in the casting process of the cylinder head leads to the problem of core flashes in the connection regions of the different cores. The water cooling system often comprises an upper water jacket and a lower water jacket in the cylinder head. Therefore for the casting process of the cylinder head an upper water jacket core and a lower water jacket core are used. In the casted cylinder the upper water jacket and the lower water jacket are usually separated by a horizontal wall and connected by one or more dedicated transition channels. The above mentioned connection area of the upper water jacket core and the lower water jacket core is normally located in this one or more transition channels. It is know for the water jacket cores to provide flat surfaces, wherein these flat surfaces of the water jacket cores are arranged at each other, preferably in the middle of the transition channel in a vertical direction. This leads to the problem that during the casting process, casting material of the cylinder head can intrude between the two water jacket cores, causing a so-called core flash. These core flashes are located directly at a side wall of the transition channel reducing the width of the transition channel and obstruct the flow path for the cooling water. Therefore a removal of these core flashes is often necessary. However, removing these core flashes imply the danger of a damage done to a side wall of the transition channel caused during the removing process.

It is an object of the present invention to solve the aforesaid problems and drawbacks at least partly. In particular, it is an object of the present invention to provide a method for manufacturing a water cooling system inside a casted cylinder head and a water cooling system inside a casted cylinder head, which allow in an easy and cost-efficient way an exact calibration of the width of the transition channel between an upper water jacket and a lower water jacket of a water cooling system and which allow further the removal of core flashes in the transition channel, wherein simultaneously a damage done to a side wall of the transition channel is prohibited.

The aforesaid problems are solved by a method for manufacturing a water cooling system inside a casted cylinder head according to independent claim 1 and by a water cooling system inside a casted cylinder head according to independent claim 9. Further features and details of the present invention result from the subclaims, the description and the drawings. Features and details discussed with respect to the method can also be applied to the water cooling system and vice versa, if of technical sense.

According to a first aspect of the invention the aforesaid object is achieved by a method for manufacturing a water cooling system inside a casted cylinder head, the water cooling system comprising an upper water jacket and a lower water jacket and wherein a transition channel is located between the upper water jacket and the lower water jacket. A method according to the invention is characterized by the following steps:

a) Arranging an upper water jacket core for the upper water jacket and a lower water jacket core for the lower water jacket, wherein the upper water jacket core and the lower water jacket core are adjoining to each other in and/or at the region of the transition channel to be manufactured and wherein at least one of the water jacket cores comprises a recess at the region of the transition channel to be manufactured, b) Casting of the cylinder head, wherein due to the recess a protrusion is formed and due to the arrangement of the water jacket cores a core flash is formed on the protrusion and wherein the transition channel to be manufactured is at least partly blocked by the protrusion and the core flash, c) Removing of the upper water jacket core and the lower water jacket core and d) Adjusting the width of the transition channel to be manufactured by removing the core flash and at least a part of the protrusion.

Applying the method according to the invention a water cooling system is manufactured inside a casted cylinder head which is divided in an upper water jacket and a lower water jacket. The two water jackets are fluidly connected by a transition channel, which is preferably arranged in a vertical direction in the cylinder head. The upper water jacket and the lower water jacket are separated in the casted cylinder head by a horizontal wall and only the transition channel allows the cooling water to flow between the two water jackets.

In step a) of the method according to the invention an upper water jacket core and a lower water jacket core are arranged such that they contact each other in and/or at the region of the transition channel. This contact area of the water jacket cores is preferably arranged in a vertical direction in the middle of the transition channel. The recess comprised by at least one of the water jacket cores is preferably also arranged on one of the water jacket cores in or at this contact area. During the casting process in step b) of the method according to the invention hot metal, preferably aluminum, is used to cast the cylinder head. Due to the casting process this melted metal can end up between the cores in the contact area, building a so-called core flash. Due to the fact that a recess is formed at at least one of the water jacket cores at the region of the transition channel, this core flash is automatically arranged at a protrusion formed due to the recess. A build-up of the core flash on a side wall of the transition channel to be manufactured can therefore be prohibited. After the casting process and a certain coolingoff of the casted cylinder head the water jacket cores are removed from inside the casted cylinder head. In this condition, the transition channel is at least partly blocked by the protrusion and the core flash, which is located at the protrusion. The present width of the transition channel is in this condition not suitable for a nominal operation of the water cooling system. Therefore, in step d) of the method according to the invention, the width of the transition channel to be manufactured is adjusted. To achieve this, the core flash and at least part of the protrusion is removed. As noted above, the core flash is exclusively located at the protrusion. By removing of at least part of the protrusion therefore the core flash is completely removed. In addition, the amount of material removed of the protrusion can be chosen according to the desired design of the transition channel, especially regarding the width of the transition channel. Due to the fact that the core flash is exclusively arranged at the protrusion and not at a side wall of the transition channel, a damage done to the side wall during the removal process can be prohibited. Therefore, a method according to the invention allows the exact calibration of a width of a transition channel in a water cooling system and simultaneously allows the complete removal of a core flash in the transition channel without the danger of a damage done to the side wall of the transition channel.

In addition, a method according to the invention can be characterized in that in step d) the removing includes drilling. Drilling is an especially easy and cost-efficient way to remove at least a part of the protrusion and the core flash. By applying a variation in the depth of the drilling and/or the size of the drill and/or by including a sideward movement of the drill different resulting widths of the transition channel can be obtained. A calibration of the width of the transition channel can therefore be achieved in a very easy way.

In an especially preferred embodiment of the method according to the invention the drilling is performed in a direction perpendicular to an intended flow direction of the cooling water in the transition channel. During the operation of an engine using a cylinder head with a water cooling system according to the invention, cooling water may flow between the upper water jacket and the lower water jacket. The transition channel connects the upper water jacket and the lower water jacket. Therefore in a possible embodiment cooling water leaves the upper water jacket through an opening connected to a first end of the transition channel and enters the transition channel at the first end of the transition channel. Afterwards it flows through the transition channel, leaves the transition channel at a second end of the transition channel and enters the lower water jacket through an opening in the lower water jacket connected to the second end of the transition channel. In another embodiment also a flow of cooling water from the lower water jacket through the transition channel into the upper water jacket is possible. Therefore the intended flow direction is pointing from the opening in the upper (lower) water jacket to the opening in the lower (upper) water jacket, especially following the general direction of the transition channel. In most of the cases the transition channel is arranged in a vertical direction. Further, the material strength, which has to be drilled through to reach the transition channel, is normally far less in the horizontal direction than in the vertical direction. Therefore, by performing the drilling in a direction perpendicular to the intended flow direction of the cooling water in the transition channel, less material has to be drilled through. This is on the one hand a very easy and cost-efficient way and on the other hand allows to remove the core flash and the protrusion with applying an as low as possible weakening to the casted cylinder head.

Further, a method according to the invention can be characterized in that a hole in the cylinder head, especially a hole in the cylinder head caused by the removing in step d), is closed with a plug. Such a hole can be, for instance, caused already by the water jacket cores during the casting process or by the removing procedure in step d). To achieve a tight water cooling system, this hole has to be closed. Using a plug to close this hole is a very easy, time- and cost-saving way. Especially, the plug can be adjusted to the width of the transition channel to be reached. An even improved adjustment and calibration of the width of the transition channel can therefore be achieved.

In addition, a method according to the invention can be characterized in that both water jacket cores comprise a recess at the region of the transition channel to be manufactured and that in step b) due to the recesses a common protrusion is formed. Therefore the recesses formed at both water jacket cores are complementing each other to result in a common protrusion. By doing so, especially the core flash is also located at the common protrusion. The contacting area of the water jacket cores, at which in the casting process a core flash can be formed, is located even farther away from a side wall of the transition channel to be manufactured. The danger of a damage of the side wall during the removal of the core flash can therefore be reduced further.

According to another preferred development of a method according to the invention the transition channel to be manufactured is completely blocked by the protrusion and the core flash. Without a removal of the core flash and at least parts of the protrusion in step d) of the method according to the invention, no flow of cooling water is possible between the upper water jacket and the lower water jacket. Therefore, the removal of the core flash and at least parts of the protrusion single-handedly defines the width of the transition channel. The calibration of the width of the transition channel can therefore be further improved due to the fact that exclusively the removal of the core flash and at least parts of the protrusion in step d) of the method according to the invention defines the width of the transition channel. No other influences on the width of the transition channel, like non-blocked parts of the transition channel, have to be considered.

Further, a method according to the invention can be characterized in that in step a) the upper water jacket core and the lower water jacket core are arranged in the vicinity of an exhaust core. Such an exhaust core defines the cavities for an exhaust to be manufactured in the cylinder head. In modern combustion engines also a cooling of an exhaust of the combustion engine, especially an internal cooling of the exhaust already in the cylinder head of the combustion engine, is preferred. By arranging the upper water jacket core and the lower water jacket core in the vicinity of an exhaust core the resulting water cooling system is enabled to cool the exhaust and the exhaust gases already inside the cylinder head. To achieve an especially good cooling, the side wall of the transition channel is preferably thin to improve the heat transfer between the exhaust and the cooling water in the water cooling system. By using a method according to the invention this side wall can be constructed in an especially thin way due to the fact that no security margins for the core flash removal have to be considered. A better cooling of an exhaust already inside a cylinder head can therefore be achieved.

In a further improvement of a method according to the invention the upper water jacket core and the lower water jacket core are arranged such that the exhaust core is at least in sections surrounded by the upper water jacket core and the lower water jacket core. Therefore, the resulting exhaust in the cylinder head is at least in sections completely surrounded by parts of the water cooling system. An even better cooling of the exhaust can therefore be achieved.

Further, according to a second aspect of the invention the object is solved by a water cooling system inside a casted cylinder head, comprising an upper water jacket and a lower water jacket, wherein the upper water jacket and the lower water jacket are fluidly connected by at least one transition channel. A water cooling system according to the invention is characterized in that after the casting of the cylinder head the transition channel is at least partly blocked by a protrusion and a core flash arranged at the protrusion and that the width of the transition channel is adjusted by removing the core flash and at least a part of the protrusion.

By doing so, the width of the transition channel can be exactly calibrated due to the removal of material of the core flash and at least parts of the protrusion. Due to the fact that the core flash is arranged at the protrusion a complete removal of the core flash is already possible by a removal of at least parts of the protrusion. Damage to a side wall of the transition channel can therefore be prohibited. This allows the side walls to be manufactured thinner whereby a heat transfer through this side wall can be improved. A water cooling system according to the invention therefore allows an exact calibration of a width of a transition channel between an upper water jacket and a lower water jacket and simultaneously reduces the danger of a damage done to the side wall of the transition channel.

Preferably a water cooling system inside a casted cylinder head is characterized in that the water cooling system is manufactured using a method according to the first aspect of the invention. This provides for the water cooling system the same advantages, which have been discussed in detail according to a method according to the first aspect of the invention.

Figure 2:
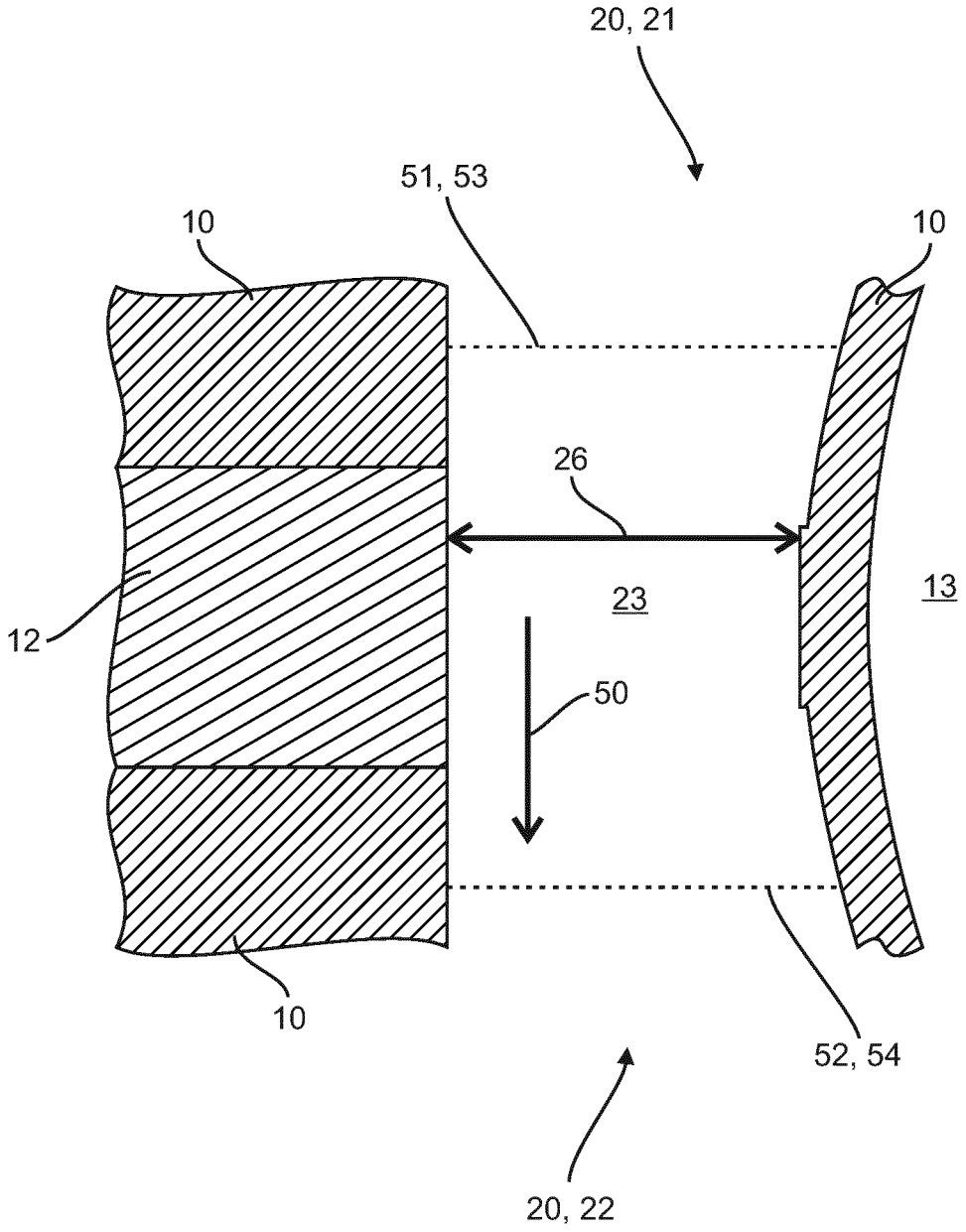

The present invention is described with respect to the accompanied figures. The figures show schematically:

FIGS. 1*a, b, c* a method for manufacturing a water cooling system according to the invention and FIG. 2 a water cooling system according to the invention.

Elements having the same functions and mode of action are provided in FIGS. 1*a, b, c* and 2 with the same reference signs.

Figure 1B:
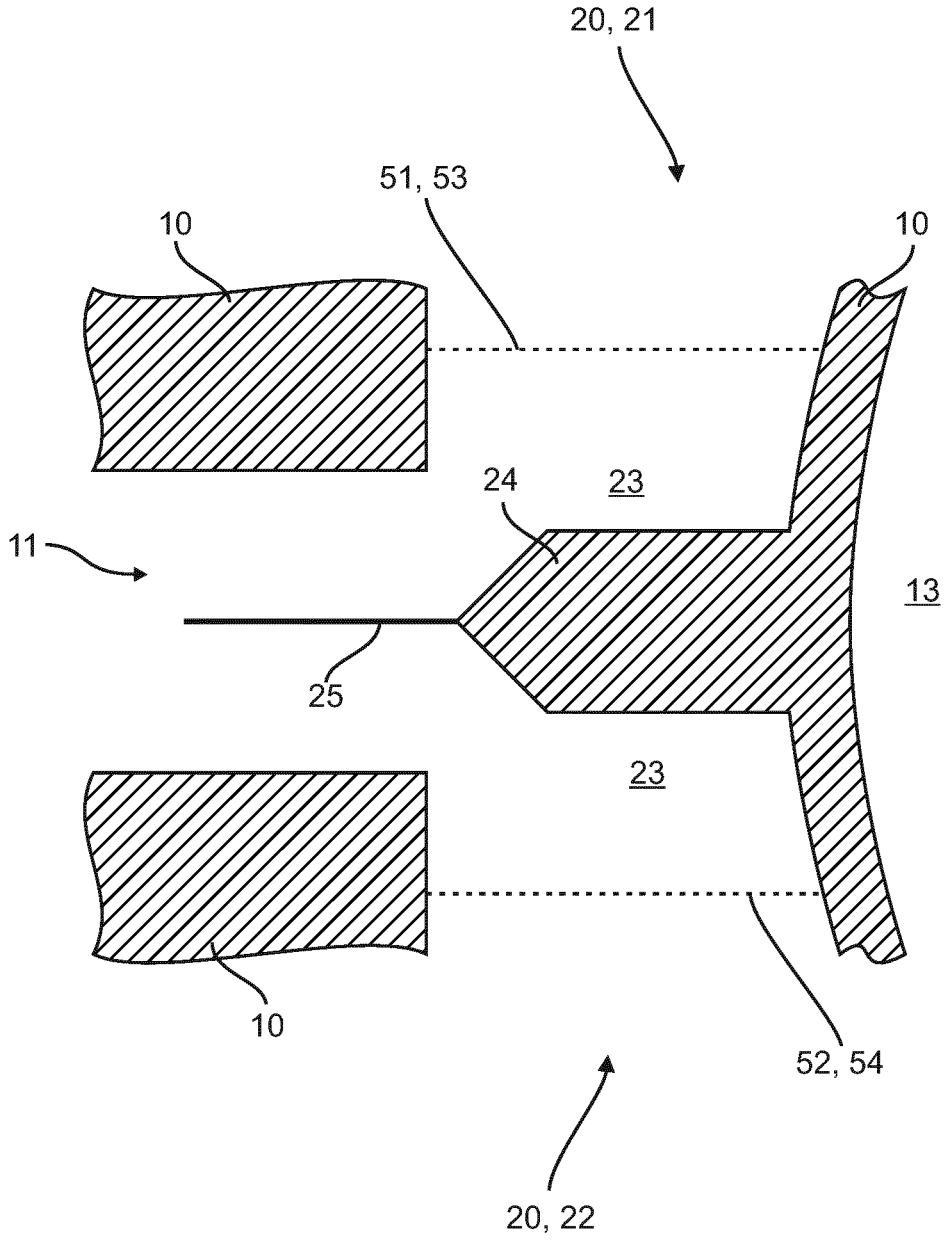
Figure 1C:
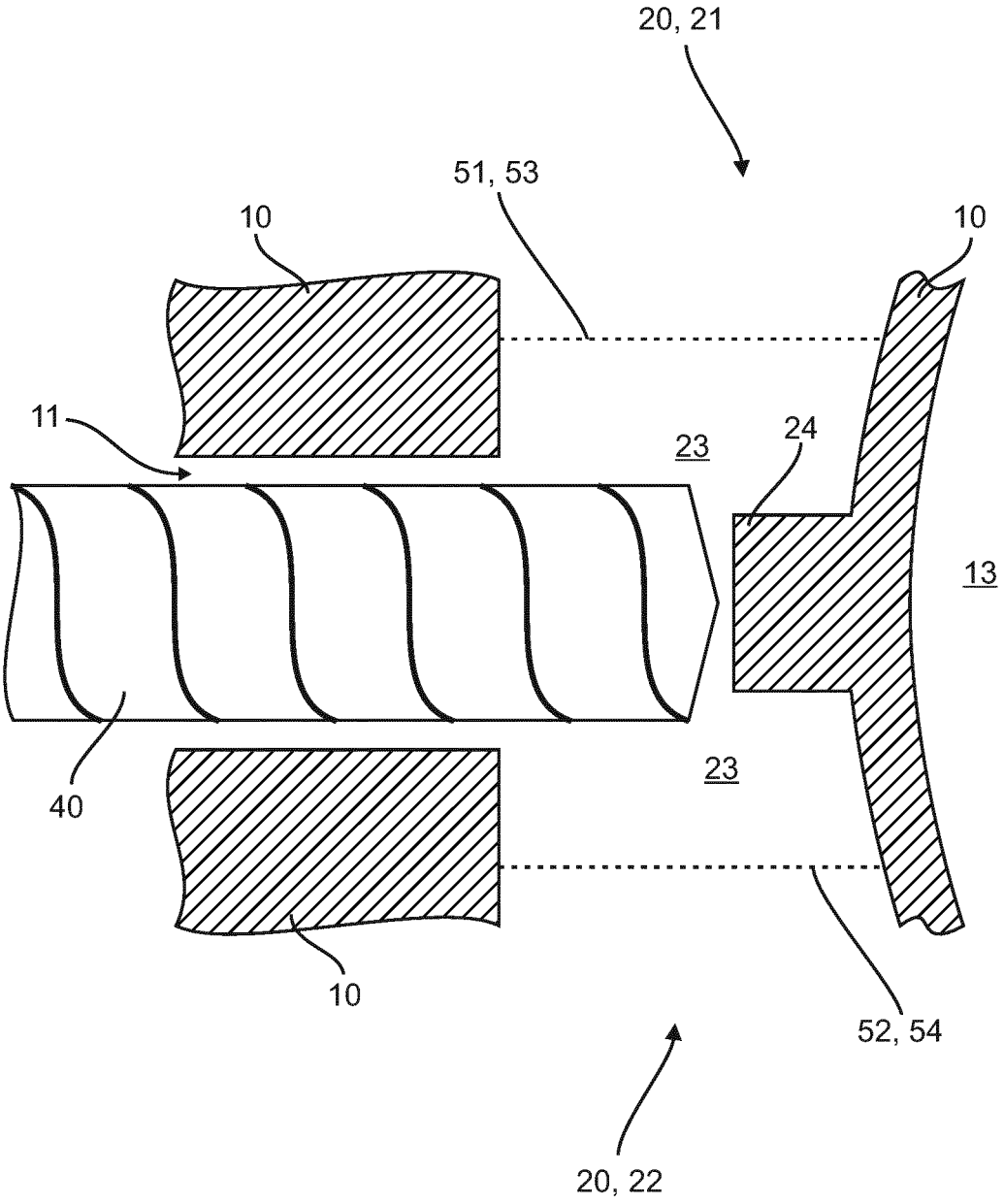

In the FIGS. 1*a, b, c* a method for manufacturing a water cooling system 20 inside a casted cylinder head 10 is depicted. FIG. 1*a* shows especially step a) of the method according to the invention. An upper water jacket core 30 and a lower water jacket core 31 are arranged at each other. Only the parts of the water jacket cores 30, 31, which are located in an area of the transition channel 23 (see FIGS. 1*b, c*) to be manufactured are shown. Both water jacket cores 30, 31 comprise a recess 32 located at a contact region of the water jacket cores 30, 31. In addition, an exhaust core 33 is shown. All other parts needed for the casting process of the cylinder head 10 (not shown), like a casting mold, are not depicted. In FIG. 1*b* the result of the casting process is shown after the removal of the cores 30, 31, 33 (not shown). In the casted cylinder head 10 cavities are formed for the water cooling system 20 and the exhaust 13. The water cooling system 20 is split into an upper water jacket 21, a lower water jacket 22 and a transition channel 23 which fluidly connects the two water jackets 21, 22. An opening 51 of the upper water jacket 21 is connected to a first end 53 of the transition channel 23 and an opening 52 of the lower water jacket 22 is connected to a second end 54 of the transition channel 23. Due to the shape of the water jacket cores 30, 31 (not shown), also a hole 11 is formed in the casted cylinder head 10. It is clearly visible that on the side wall of the casted cylinder head 10 between the transition channel 23 of the water cooling system 20 and the exhaust 13 due to the recesses 32 on the water jacket cores 30, 31 a common protrusion 24 is formed. During the casting process molded metal got between the water jacket cores 30, 31 in the contact region between the water jacket cores 30, 31. That is why on the tip of the protrusion 24 a core flash 25 is formed. It is also clearly visible that the transition channel 23 is almost completely blocked by the protrusion 24 and the core flash 25. Therefore, in step d) of the method according to the invention an adjusting of the width 26 (see FIG. 2) is an important part of the method according to the invention. In this embodiment of the method according to the invention, the removal of the core flash 25 and the protrusion 24 is achieved by using a drill 40. The drill 40 is inserted through the hole 11 and used to remove material of the core flash 25 and the protrusion 24. By choosing the size of the drill 40 and/or the depth of the drilling and/or a sideward movement of the drill 40 the width 26 of the transition channel 23 can be exactly calibrated. Due to the fact that the core flash 25 is exclusively arranged at the protrusion 24, damage to a side wall of the casted cylinder head 10 between the transition channel 23 and the exhaust 13 can be easily prohibited. Using a method according to the invention it is therefore possible to reach an exact calibration of the width 26 of the transition channel 23, a complete removal of core flashes 25 and simultaneously prohibiting a damage done to a side wall in the casted cylinder head 10 between the transition channel 23 and the exhaust 13. The drill 40 is inserted in this embodiment of the method according to the invention in a direction perpendicular to an intended flow direction 50 (see FIG. 2) in the transition channel 23 to be manufactured. This has the advantage that less material of the cylinder head 10 has to be drilled through. This is on the one hand a very easy and cost-efficient way and on the other hand allows to remove the core flash 25 and the protrusion 24 with applying an as low as possible weakening to the casted cylinder head 10.

In FIG. 2 a water cooling system 20 inside a casted cylinder head 10 according to the invention is shown. Especially, the water cooling system 20 shown in FIG. 2 was manufactured using a method according to the invention as shown in FIGS. 1*a, b, c*. The hole 11 is now filled with a plug 12, wherein the plug 12 is adjusted to ensure the calibrated width 26 of the transition channel 23. The upper water jacket 21 and the lower water jacket 22 are now connected by the transition channel 23 and cooling water can flow in the flow direction 50 between the two water jackets 21, 22 to cool exhaust gases in the exhaust 13. The transition channel 23 connects the upper water jacket 21 and the lower water jacket 22. Therefore in the shown embodiment cooling water leaves the upper water jacket 21 through an opening 51 connected to a first end 53 of the transition channel 23 and enters the transition channel 23 at the first end 53 of the transition channel 23. Afterwards it flows through the transition channel 23, leaves the transition channel 23 on a second end 54 of the transition channel 23 and enters the lower water jacket 22 through an opening 52 in the lower water jacket 22 connected to the second end 54 of transition channel 23. In an alternative embodiment also a flow of cooling water from the lower water jacket 22 through the transition channel 23 into the upper water jacket 21 is possible (not shown). Therefore the intended flow direction 50 is pointing from the opening 51, (52) in the upper (lower) water jacket 21, (22) to the opening 52, (51) in the lower (upper) water jacket 22, (21), especially following the general direction of the transition channel 23 (the reference signs in brackets are related to the alternative, not shown embodiment). A water cooling system 20 according to the invention has especially the advantages that the width 26 of the transition channel 23 can be exactly calibrated. Another advantage of a water cooling system 20 according to the invention arises due to the fact that the side wall of the casted cylinder head 10 between the transition channel 23 and for instance an exhaust 13 can be manufactured as thin as possible due to the fact that security margins for the removal of core flashes 25 after the casting process can be avoided. An improved cooling can therefore be provided.

REFERENCE SIGNS

10 Cylinder head
11 Hole
12 Plug
13 Exhaust
20 Water cooling system
21 Upper water jacket
22 Lower water jacket
23 Transition channel
24 Protrusion
25 Core flash
26 Width
30 Upper water jacket core
31 Lower water jacket core
32 Recess
33 Exhaust core
40 Drill
50 Flow direction
51 Opening in the upper water jacket
52 Opening in the lower water jacket
53 First end of the transition channel
54 Second end of the transition channel

The invention claimed is:

1. A method for manufacturing a water cooling system inside a casted cylinder head, the water cooling system comprising an upper water jacket and a lower water jacket and wherein a transition channel is located between the upper water jacket and the lower water jacket, characterized in following steps:

a) Arranging an upper water jacket core for the upper water jacket and a lower water jacket core for the lower water jacket, wherein the upper water jacket core and the lower water jacket core are placed in contact with each other and are adjoining to each other at least in or at the region of the transition channel to be manufactured so that a recess is defined by at least one of the water jacket cores at the region of the transition channel to be manufactured, b) Casting of the cylinder head, wherein due to the recess a protrusion is formed and due to the arrangement of the water jacket cores a core flash is formed on the protrusion and wherein the transition channel to be manufactured is at least partly blocked by the protrusion and the core flash, c) Removing of the upper water jacket core and the lower water jacket core, and d) Adjusting the width of the transition channel to be manufactured by removing the core flash and at least a part of the protrusion.

2. The method according to claim 1, wherein in step d) the removing includes drilling.

3. The method according to claim 2, wherein the drilling is performed in a direction perpendicular to an intended flow direction of the cooling water in the transition channel.

4. The method according to claim 1, wherein a hole in the cylinder head, is closed with a plug.

5. The method according to claim 4, wherein a hole in the cylinder head caused by the removing in step d) is closed with a plug.

6. The method according to claim 1, wherein both water jacket cores comprise a recess at the region of the transition channel to be manufactured and that in step b) due to the recesses a common protrusion is formed.

7. The method according to claim 1, wherein in step b) the transition channel to be manufactured is completely blocked by the protrusion and the core flash.

8. The method according to claim 1, wherein in step a) the upper water jacket core and the lower water jacket core are arranged in the vicinity of an exhaust core.

9. The method according to claim 8, wherein the upper water jacket core and the lower water jacket core are arranged such that the exhaust core is at least in sections surrounded by the upper water jacket core and the lower water jacket core.

* * * * *